US006374444B2

(12) United States Patent
Skrippek et al.

(10) Patent No.: US 6,374,444 B2
(45) Date of Patent: Apr. 23, 2002

(54) METHOD FOR DETERMINING THE LOADING WEIGHT OF A LAUNDRY DRUM AND A LAUNDRY-PROCESSING MACHINE FOR CARRYING OUT THE METHOD

(75) Inventors: Jörg Skrippek, Priort; Reinhard Heyder, Berlin, both of (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/758,334

(22) Filed: Jan. 10, 2001

Related U.S. Application Data

(63) Continuation of application No. PCT/EP99/04983, filed on Jul. 14, 1999.

(30) Foreign Application Priority Data

Jul. 17, 1998 (DE) ..... 198 32 292

(51) Int. Cl.[7] ..... D06F 33/02
(52) U.S. Cl. ..... 8/159; 68/12.04
(58) Field of Search ..... 8/159; 68/12.04

(56) References Cited

U.S. PATENT DOCUMENTS 5,335,524 A * 8/1994 Sakane ..... 68/12.04
5,507,055 A * 4/1996 Blauert et al. ..... 68/12.04 X
6,029,299 A * 2/2000 Baek et al. ..... 68/12.04 X

* cited by examiner

*Primary Examiner*—Philip R. Coe
(74) *Attorney, Agent, or Firm*—Herbert L. Lerner; Laurence A. Greenberg; Werner H. Stemer

(57) ABSTRACT

A method and appliance for determining the angular position of a laundry drum and a power consumption of an electric motor driving the drum to derive therefrom a laundry weight in the drum includes directly driving the drum with the motor from a lower laundry position to a raised position where a laundry center of gravity is offset from a rotation axis to produce a loading weight from the driving current of the electric motor measured when the raised position is reached. Alternatively or additionally, the drum is turned until the controller detects a power consumption of the electric motor corresponding to a stored maximum current value to derive a weight of the laundry from a signal corresponding to the angular distance. The controller stores a predetermined, defined maximum current value and measures a power consumption of the electric motor.

24 Claims, 1 Drawing Sheet

Fig. 1
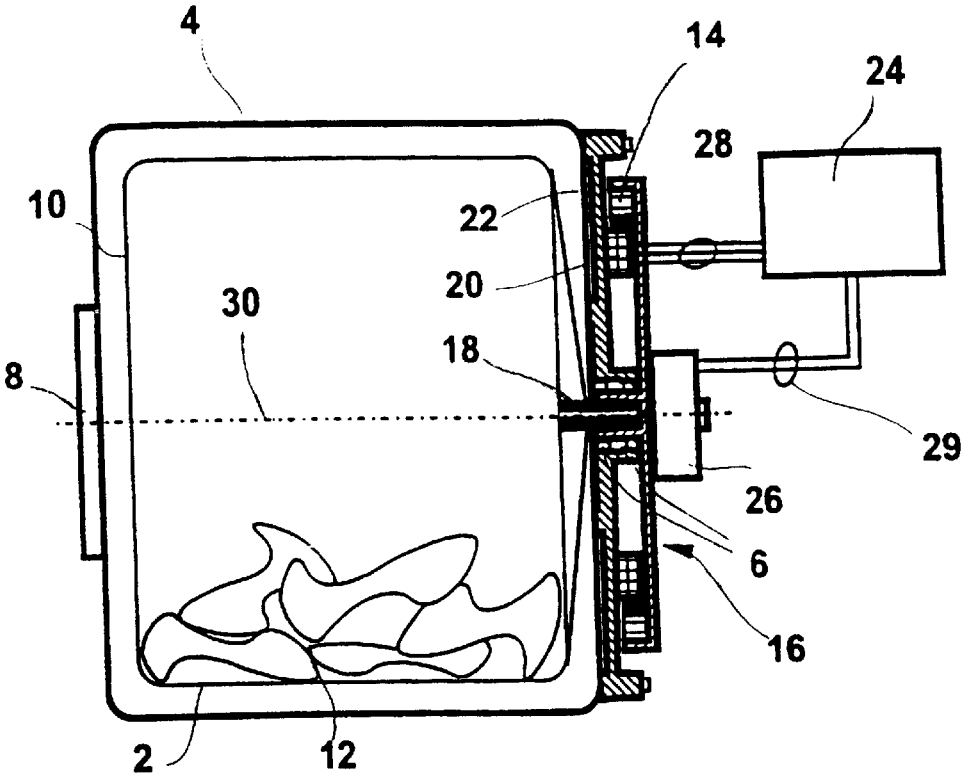
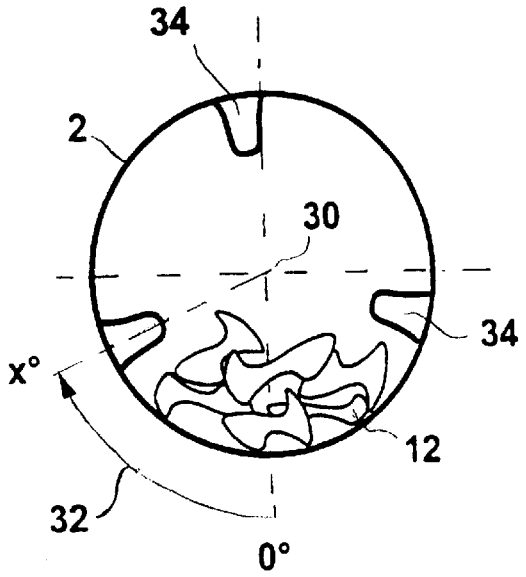
Fig. 2
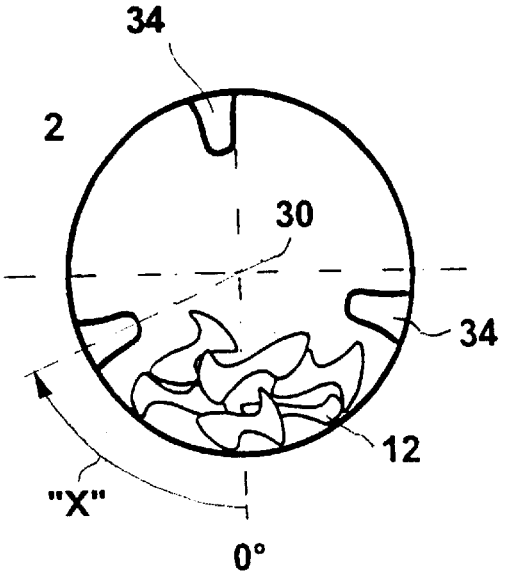
Fig. 3

METHOD FOR DETERMINING THE LOADING WEIGHT OF A LAUNDRY DRUM AND A LAUNDRY-PROCESSING MACHINE FOR CARRYING OUT THE METHOD

CROSS-REFERENCE TO RELATED APPLICATIONS

This application is a continuation of copending International Application No. PCT/EP99/04983, filed Jul. 14, 1999, which designated the United States.

BACKGROUND OF THE INVENTION

Field of the Invention

The invention lies in the field of household appliances. The invention relates to a method for determining the loading weight of a laundry drum in a washing machine or in a washer dryer, the drum being driven directly by an electric motor controlled by an electronic control or regulating device, and to an electric machine in the form of a washing machine or a washer dryer for carrying out a method according to the invention.

The prior art includes a washing machine with a laundry drum that is driven about a horizontal axis of rotation by an electric motor and that has a closable loading aperture disposed on its periphery. The laundry drum can be loaded with laundry when it stops in a rotational position at which the loading aperture is at the top. An electronic control or regulating device for controlling the electric motor that drives the drum is configured such that it always stops the drum in the rotational position at which its loading aperture is at the top.

German Published, Non-prosecuted Patent Application DE 44 31 846 A1 discloses a method for controlling and/or regulating a washing machine or a washer dryer. The method is used for a laundry drum when the drum is rotating at a speed at which the laundry comes to rest in a manner distributed around the inner circumference. The method is also used to calculate the unbalance of laundry distributed in a non-uniform manner around its circumference of the drum. Further, the method is used to calculate the total weight of the laundry (loading) contained in the laundry drum and to control or regulate as a function of these two values the speed of a motor that drives the laundry drum. The method is carried out with the laundry drum loaded (filled with laundry) when the drum is rotating at least at a "spreading speed." The "spreading speed" is the speed of the laundry drum at which the laundry distributes itself around the inner circumference of the drum. While the laundry drum is starting up, high unbalance torques can occur because they are not taken into account. The method furthermore requires a complicated and expensive electronic device for detecting angular accelerations of the laundry drum.

German Published, Non-prosecuted Patent Application DE 195 46 185 A1, corresponding to U.S. Pat. No. 5,809,809, discloses a washing machine having a laundry drum that is driven directly by an electric motor rather than through a drive belt. As such, a rotor of an electric motor is connected firmly in terms of rotation to a drive shaft of the laundry drum, and the stator of the electric motor is secured non-rotatably on the rear wall of the laundry drum housing (washing-liquid container). Precise synchronism between the motor and the laundry drum is thereby achieved.

SUMMARY OF THE INVENTION

It is accordingly an object of the invention to provide a method for determining the loading weight of a laundry drum and a laundry-processing machine for carrying out the method that overcomes the hereinafore-mentioned disadvantages of the heretofore-known methods and devices of this general type and that precisely determines the loading of the laundry drum (the weight of the laundry contained in the laundry drum) in a simple and economical manner, even when the machine is not rotating at the operating speed, and that can be used for any desired purpose, in particular, for indicating the loading weight and/or for controlling or regulating the speed and/or acceleration of the laundry drum and/or the duration of processing of the batch of laundry in the laundry drum.

With the foregoing and other objects in view, there is provided, in accordance with the invention, a method for determining a loading weight of a horizontally mounted laundry drum, including the steps of providing a laundry drum driven by an electric motor controlled by a controller, the laundry drum having an axis of rotation, directly driving the laundry drum with the electric motor, turning the laundry drum with the electric motor from a 0° angular position, in which laundry is lying in a lower position in the laundry drum, through a rotational angle until reaching an angular position at which the laundry is in a raised position and at which a center of gravity of the laundry is at a lateral distance from a vertical plane extending through the axis of rotation, detecting the reaching of the angular position with the controller, and producing a measured value corresponding to a loading weight of the laundry from a driving current of the electric motor measured when the angular position is reached.

With the objects of the invention in view, there is also provided a method for determining a loading weight of a horizontally mounted laundry drum, including the steps of providing a laundry drum driven by an electric motor controlled by a controller, the laundry drum having an axis of rotation, directly driving the laundry drum with the electric motor, storing a predetermined, defined maximum current value in the controller, measuring a power consumption of the electric motor, rotating the laundry drum with the electric motor out of a 0° angular position, in which laundry lies in a lower position in the laundry drum, until the controller detects, during the rotation of the laundry drum, a power consumption of the electric motor corresponding to the stored maximum current value, the rotation resulting in a raising of the laundry into a position in which a center of gravity of the laundry is at a lateral distance from a vertical plane extending through the axis of rotation, and the rotation resulting in an angular traveling of the laundry drum to an angular distance from the 0° angular position, and producing a measured value corresponding to a loading weight of the laundry from a signal corresponding to the angular distance.

In accordance with another mode of the invention, the electric motor receives and transmits at least one of power consumption signals and control signals, and further includes the steps of producing the control signals with the controller dependent on angular positions of a rotor of the electric motor relative to a stator of the electric motor, and defining or calculating with the controller an angular distance through which the laundry drum is turned from the 0° angular position to reach the angular position at which the loading weight of the laundry is determined by the controller using fluctuations in at least one of the power consumption signals and control signals.

In accordance with a further mode of the invention, the laundry drum is part of a washing machine or a washer/dryer.

In accordance with an added mode of the invention, the controller is an electronic control or regulating device.

In accordance with an additional mode of the invention, the electric motor is an electronically commutated d.c. motor, and further includes the step of defining or calculating the angular distance or position using a number of commutation steps from the 0° angular position of the laundry drum to the angular position at which the loading weight is determined.

In accordance with yet another mode of the invention, the electric motor is an electronically controlled reluctance motor.

In accordance with yet a further mode of the invention, there are also provided the steps of detecting an angular position of the laundry drum with a tachogenerator as a function of angular movements of the laundry drum to produce electric pulses, and measuring angular distance traveled with a number of the electric pulses.

With the objects of the invention in view, there is also provided a washing appliance, including a stationary component, a laundry drum rotatably mounted on the stationary component about a horizontal axis of rotation, the drum moving through a 0° angular position, in which laundry is lying in a lower position in the laundry drum, and through an angular position at which the laundry is in a raised position and at which a center of gravity of the laundry is at a lateral distance from a vertical plane extending through the axis of rotation, an electric motor directly connected to the laundry drum for driving the laundry drum, a controller connected to the electric motor, the controller configured to determine a loading weight of the laundry drum when the laundry drum is turned with the electric motor from the 0° angular position to the angular position by measuring an electric driving current of the electric motor at the angular position to produce a measured value corresponding to the loading weight of the laundry.

With the objects of the invention in view, there is also provided a washing appliance, including a stationary component, a laundry drum rotatably mounted on the stationary component about a horizontal axis of rotation, the drum moving through a 0° angular position, in which laundry is lying in a lower position in the laundry drum, and through an angular position at which the laundry is raised and at which a center of gravity of the laundry is at a lateral distance from a vertical plane extending through the axis of rotation, an electric motor directly connected to the laundry drum for driving the laundry drum, and a controller connected to the electric motor for detecting a power consumption of the electric motor and having a stored predetermined, defined maximum current value, the controller configured to determine a loading weight of the laundry drum when the laundry drum is driven from the 0° angular position stored in the controller until the controller detects during rotation of the laundry drum that a power consumption of the electric motor corresponds to the stored maximum current value, and to measure an angular distance traveled from the 0° angular position for producing a measured value corresponding the loading weight of the laundry.

In accordance with yet an added feature of the invention, the appliance one a washing machine or a washer/dryer.

In accordance with a concomitant feature of the invention, the controller is an electronic control or regulating device.

The invention achieves its objectives by implementing measurement of loading in a simple and economical manner on a laundry-processing machine. The results of the measurement are accurate enough to be used as parameters in control or regulation of the laundry-processing machine. A laundry-processing machine equipped in accordance with the invention avoids the dry movement of the laundry in the laundry drum, which is required by prior art methods and involves considerable wear on the laundry due to severe friction between the fibers resting upon one another.

Other features that are considered as characteristic for the invention are set forth in the appended claims.

Although the invention is illustrated and described herein as embodied in a method for determining the loading weight of a laundry drum and a laundry-processing machine for carrying out the method, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 1 is a diagrammatic, axial cross-sectional view of a machine with an electronic control or regulating device according to the invention;

FIG. 2 is a diagrammatic, cross-sectional view through the laundry drum of FIG. 1 with laundry lying at a lowest point according to the invention; and FIG. 3 is another diagrammatic, cross-sectional view through the laundry drum of FIG. 1 with laundry lying at a lowest point according to the invention.

DESCRIPTION OF THE PREFERRED EMBODIMENTS

In all the figures of the drawing, sub-features and integral parts that correspond to one another bear the same reference symbol in each case.

Referring now to the figures of the drawings in detail and first, particularly to FIG. 1 thereof, there is shown an electric machine in the form of a washing machine or a washer dryer. The machine includes a laundry drum 2 that is rotatably mounted at the rear in a washing-liquid container 4 by bearings 6 and can be loaded with laundry 12 at the front through a door 8 provided in the washing-liquid container 4 and a loading aperture formed in the front side 10.

A rotor 14 of an electric motor 16 is connected directly and firmly in terms of rotation to a drive shaft 18 of the laundry drum 2 such that no differences in rotational position can occur between the rotor 14 and the drive shaft 18. A stator 20 of the electric motor 16 is secured non-rotatably on the rear side of a rear wall 22 of the washing-liquid container 4. An electronic control or regulating device 24 supplies and controls or regulates the electric motor 16 through lines 28.

According to preferred embodiments of the invention, the electric motor 16 is an electronically commutated d.c. motor, an electrically switched reluctance motor, or an electric motor. The control or regulating device 24 can determine the angular positions of the rotor 14 and, therefore, also of the laundry drum 2 by commutation steps or control pulses, which it must supply to the electric motor 16 to supply the motor 16 with power, or which exhibits fluctuations in power consumption as a function of its rotational position, as in the case of a reluctance motor, which can be detected by the control or regulating device 24.

For motors of the type mentioned above, it is not necessary to use additional sensors, e.g., a tachogenerator 26, to determine the rotational positions and angular distances by which the laundry drum 2 rotates. It is, of course, also possible to use a tachogenerator 26. With other types of electric motors 16, an additional sensor, preferably a tachogenerator 26 that supplies appropriate signals to the control or regulating device 24, is required to detect the respective angular position of and angular distance traveled by the laundry drum from an initial angular position to an angular end position. Power-supply and electric signal lines 28 connect the control or regulating device 24 to the electric motor 16. Power-supply and/or electric signal lines 29 connect the control or regulating device 24 to the additional device, e.g., the tachogenerator 26, where present.

The invention is described below without a tachogenerator 26, using examples in which the control or regulating device 24 contains a position detection device for detecting angular positions and angular distances of the rotor 14, which is connected directly to the laundry drum 2 in terms of drive. The electric motor 16 is an electronically commutated d.c. motor, an electronically switched reluctance motor, or a similar motor.

The principles on which the motors are based permit a relatively high-resolution, i.e., very accurate, position detection device in the control or regulating device 24 for determining the angular position of the rotor and angular velocity of the rotor. With the aid of such a position detection device, the angular position of and angular distance turned by the laundry drum 2 can be determined relatively accurately at any time. In contrast to an indirect drive (V-belt between the electric motor and the drive shaft of the laundry drum), no additional synchronization devices are required. Using the invention, determination of the rotational angle of the laundry drum 2 (rotor 14 of the electric motor 16) is combined with measurement of the power consumption of the electric motor 16.

FIRST EXAMPLE

FIG. 2 shows a cross-section of the laundry drum 2 in a 0° angular position, in which all the laundry 12 loaded into the drum 2 is at the bottom. Here, the center of gravity of the laundry 12 is perpendicularly below the drum's axis of rotation 30. When the laundry drum 2 is turned by the electric motor 16 from the 0° angular position through a defined, predetermined angular distance 32 to an x° angular position, the distance 32 is stored in the control or regulating device 24. As such, the laundry 12 has been raised into a raised position just before the point at which it will fall. The power consumption of the electric motor 16 is measured in the x° angular position by the control or regulating device 24. The motor current is proportional to the torque in the x° angular position and, therefore, is a measure of or value for the weight of the laundry 12 (loading of the laundry drum 2).

Paddles 34 can be provided conventionally in the laundry drum 2 to take the laundry 12 along in rotation.

SECOND EXAMPLE

With respect to FIG. 3, a defined, predetermined maximum current value is stored in the electronic control or regulating device 24. The control or regulating device 24 measures the angular distance "X" by which the laundry drum 2 must be turned from the 0° angular position before the power consumption of the motor 16 reaches the stored current value. Therefore, the angular distance "X" traveled is a measure of the loading or weight of the laundry 12 in the laundry drum 2.

In both of these examples, all the laundry 12 is in the lower part of the laundry drum 2 in the 0° angular position. By turning the laundry drum 2, the laundry 12 is moved into a raised position, in which the laundry 12 is offset laterally relative to the drum's axis of rotation 30. The laterally offset position is defined by the x° angular position in the first example illustrated in FIG. 2 and by the angular distance "X" in the second example illustrated in FIG. 3.

We claim:

1. A method for determining a loading weight of a horizontally mounted laundry drum, which comprises:

providing a laundry drum driven by an electric motor controlled by a controller, the laundry drum having an axis of rotation, the laundry drum defining a vertical plane extending through the axis of rotation;

directly driving the laundry drum with the electric motor;

turning the laundry drum with the electric motor from a 0° angular position, in which laundry is lying in a lower position in the laundry drum, through a rotational angle until reaching an angular position at which the laundry is in a raised position and at which a center of gravity of the laundry is at a lateral distance from the vertical plane;

detecting the reaching of the angular position with the controller; and producing a measured value corresponding to a loading weight of the laundry from a driving current of the electric motor measured when the angular position is reached.

2. The method according to claim 1, wherein the providing step is performed by providing a washing machine having the laundry drum.

3. The method according to claim 1, wherein the providing step is performed by providing a washer/dryer having the laundry drum.

4. The method according to claim 1, wherein the controller is an electronic control device.

5. The method according to claim 1, wherein the controller is an electronic regulating device.

6. The method according to claim 1, wherein the electric motor has at least one of power consumption signals and control signals, and which further comprises:

producing the control signals with the controller dependent on angular positions of a rotor of the electric motor relative to a stator of the electric motor; and defining with the controller an angular distance through which the laundry drum is turned from the 0° angular position to reach the angular position using fluctuations in at least one of the power consumption signals and control signals.

7. The method according to claim 6, wherein the electric motor is an electronically commutated d.c. motor, and which further comprises defining the angular position using a number of commutation steps from the 0° angular position of the laundry drum to the angular position at which the loading weight is determined.

8. The method according to claim 1, wherein the electric motor is an electronically controlled reluctance motor.

9. The method according to claim 1, which further comprises:

detecting an angular position of the laundry drum with a tachogenerator as a function of angular movements of the laundry drum to produce electric pulses; and measuring angular distance traveled with a number of the electric pulses.

10. A method for determining a loading weight of a horizontally mounted laundry drum, which comprises:

providing a laundry drum driven by an electric motor controlled by a controller, the laundry drum having an axis of rotation, said drum defining a vertical plane extending through the axis of rotation;

directly driving the laundry drum with the electric motor;

storing a predetermined, defined maximum current value in the controller;

measuring a power consumption of the electric motor;

rotating the laundry drum with the electric motor out of a 0° angular position, in which laundry lies in a lower position in the laundry drum, until the controller detects, during the rotation of the laundry drum, a power consumption of the electric motor corresponding to the stored maximum current value, the rotation resulting in a raising of the laundry into a position in which a center of gravity of the laundry is at a lateral distance from the vertical plane, and the rotation resulting in an angular traveling of the laundry drum to an angular distance from the 0° angular position; and producing a measured value corresponding to a loading weight of the laundry from a signal corresponding to the angular distance.

11. The method according to claim 10, wherein the providing step is performed by providing a washing machine having the laundry drum.

12. The method according to claim 10, wherein the providing step is performed by providing a washer/dryer having the laundry drum.

13. The method according to claim 10, wherein the controller is an electronic control device.

14. The method according to claim 10, wherein the controller is an electronic regulating device.

15. The method according to claim 10, wherein the electric motor transmits and receives at least one of power consumption signals and control signals, and which further comprises:

producing the control signals with the controller dependent on angular positions of a rotor of the electric motor relative to a stator of the electric motor; and calculating with the controller the angular distance through which the laundry drum is turned from the 0° angular position to reach an angular position at which the loading weight of the laundry is determined by the controller using fluctuations in at least one of the power consumption signals and control signals.

16. The method according to claim 15, wherein the electric motor is an electronically commutated d.c. motor, and which further comprises calculating the angular distance using a number of commutation steps from the 0° angular position of the laundry drum to the angular position at which the loading weight is determined.

17. The method according to claim 10, wherein the electric motor is an electronically controlled reluctance motor.

18. The method according to claim 10, which further comprises:

detecting an angular position of the laundry drum with a tachogenerator as a function of angular movements of the laundry drum to produce electric pulses; and measuring angular distance traveled with a number of the electric pulses.

19. A washing appliance, comprising:

a stationary component;

a laundry drum rotatably mounted on said stationary component about a horizontal axis of rotation, said drum moving through a 0° angular position, in which laundry is lying in a lower position in said laundry drum, and through an angular position at which the laundry is in a raised position and at which a center of gravity of the laundry is at a lateral distance from a vertical plane extending through said axis of rotation;

an electric motor directly connected to said laundry drum for driving said laundry drum;

a controller connected to said electric motor, said controller configured to determine a loading weight of said laundry drum when said laundry drum is driven from said 0° angular position to said angular position by measuring an electric driving current of said electric motor at said angular position to produce a measured value corresponding to the loading weight of the laundry.

20. The appliance according to claim 19, wherein the appliance one of a washing machine and a washer/dryer.

21. The appliance according to claim 19, wherein the controller is one of an electronic control device and an electric regulating device.

22. A washing appliance, comprising:

a stationary component;

a laundry drum rotatably mounted on said stationary component about a horizontal axis of rotation, said drum moving through a 0° angular position, in which laundry is lying in a lower position in said laundry drum, and through an angular position at which the laundry is raised and at which a center of gravity of the laundry is at a lateral distance from a vertical plane extending through said axis of rotation;

an electric motor directly connected to said laundry drum for driving said laundry drum; and a controller connected to said electric motor for detecting a power consumption of said electric motor, said controller having a stored predetermined, defined maximum current value, said controller configured to determine a loading weight of said laundry drum when said laundry drum is driven from said 0° angular position stored in said controller until said controller detects during rotation of said laundry drum that a power consumption of said electric motor corresponds to said stored maximum current value, and to measure an angular distance traveled from said 0° angular position for producing a measured value corresponding the loading weight of the laundry.

23. The appliance according to claim 22, wherein the appliance one of a washing machine and a washer/dryer.

24. The appliance according to claim 22, wherein the controller is one of an electronic control device and an electric regulating device.

* * * * *